US009569987B2

(12) United States Patent
de Jong

(10) Patent No.: US 9,569,987 B2
(45) Date of Patent: Feb. 14, 2017

(54) LABEL FOR VEGETABLES, FRUIT AND HOUSE PLANTS

(71) Applicant: Joost Arie de Jong, Honselerdijk (NL)

(72) Inventor: Joost Arie de Jong, Honselerdijk (NL)

( * ) Notice: Subject to any disclaimer, the term of this patent is extended or adjusted under 35 U.S.C. 154(b) by 0 days.

(21) Appl. No.: 14/419,678

(22) PCT Filed: Mar. 28, 2013

(86) PCT No.: PCT/EP2013/000965
§ 371 (c)(1),
(2) Date: Feb. 5, 2015

(87) PCT Pub. No.: WO2013/143710
PCT Pub. Date: Oct. 3, 2013

(65) Prior Publication Data

US 2015/0213739 A1 Jul. 30, 2015

(30) Foreign Application Priority Data

Mar. 28, 2012 (NL) ..... 1039498

(51) Int. Cl.

| | |
|---|---|
| ***A47G 7/00*** | (2006.01) |
| ***G09F 3/20*** | (2006.01) |
| ***G09F 3/00*** | (2006.01) |
| ***G09F 3/04*** | (2006.01) |

(52) U.S. Cl.
CPC ..... *G09F 3/206* (2013.01); *G09F 3/0295* (2013.01); *G09F 3/04* (2013.01)

(58) Field of Classification Search
CPC ..... G09F 3/04; G09F 3/206; G09F 3/0288; G09F 7/18
USPC ..... 40/645
See application file for complete search history.

(56) References Cited

U.S. PATENT DOCUMENTS

| | | | | | |
|---|---|---|---|---|---|
| 1,057,362 | A * | 3/1913 | Smith | A44B 1/14 | 40/315 |
| 2,461,054 | A * | 2/1949 | Green | G09F 3/12 | 206/216 |
| 2,642,684 | A * | 6/1953 | Watts | G09F 3/04 | 40/669 |
| 2,669,047 | A * | 2/1954 | Rieger | G09F 3/14 | 40/637 |
| 3,298,374 | A * | 1/1967 | Grundell | B42F 13/006 | 211/46 |
| 3,621,809 | A * | 11/1971 | Paxton | G09F 3/206 | 40/645 |

(Continued)

FOREIGN PATENT DOCUMENTS

| | | |
|---|---|---|
| CA | 2113654 A1 | 7/1995 |
| JP | H10-153959 A | 6/1998 |

(Continued)

*Primary Examiner* — Shin Kim
(74) *Attorney, Agent, or Firm* — Hoffmann & Baron, LP

(57) ABSTRACT

A label with which, among other things, vegetables, for instance vine tomatoes, fruit and house plants, can be supplied with information. The label is a three-dimensional object obtained by folding and gluing a punched or cut piece of paper, cardboard or another type of thin-walled material, which object can be attached to one or more branches of a vine of tomatoes and whereby at least one surface area of the three-dimensional object is visible in such a way that it can serve as an information-bearing surface.

14 Claims, 4 Drawing Sheets

(56) References Cited

U.S. PATENT DOCUMENTS 4,379,372 A * 4/1983 Alexander ..... G09F 3/04 40/316
4,539,767 A * 9/1985 Jaffe ..... F16L 1/11 40/316
4,662,094 A * 5/1987 Jaffe ..... F16L 1/11 40/316
5,014,957 A * 5/1991 Nichol, Jr. ..... A47G 25/36 206/806
5,422,152 A * 6/1995 Langeland ..... F17C 13/003 24/304
5,645,300 A * 7/1997 Hill ..... B65D 75/54 283/101
5,697,177 A * 12/1997 Ludlow ..... G09F 3/14 40/663
5,913,619 A * 6/1999 Lowe ..... G09F 3/04 24/18
6,434,870 B1 * 8/2002 Fanjoy ..... G09F 21/02 40/636
6,695,364 B2 * 2/2004 Bierlin ..... B65D 33/14 24/16 PB
6,729,059 B1 * 5/2004 Overdevest ..... G09F 15/0037 40/645
6,793,071 B2 * 9/2004 Rhyne ..... B65D 71/46 206/223
6,857,801 B2 * 2/2005 Van Bever ..... B41J 3/4075 40/316
7,004,441 B1 * 2/2006 Rutland ..... G09F 23/00 248/690
7,073,282 B2 * 7/2006 Savagian ..... G09F 3/0295 24/129 B
7,257,916 B2 * 8/2007 Hall ..... G09F 3/04 206/806
7,263,794 B2 * 9/2007 Gilbertie ..... G09F 3/04 40/606.19
7,275,341 B1 * 10/2007 Kincaid ..... G09F 3/12 40/645
D617,844 S * 6/2010 Stone ..... D20/27
7,975,414 B2 * 7/2011 Ritamaki ..... G06K 19/07749 283/81
8,240,073 B1 * 8/2012 Vulgamott ..... A01G 9/02 40/645
8,458,940 B2 * 6/2013 Davidson ..... G09F 3/04 2/145
2006/0174667 A1 * 8/2006 Garner ..... E05B 73/0017 70/57.1
2011/0023342 A1 * 2/2011 Davidson ..... G09F 3/04 40/638
2015/0213739 A1 * 7/2015 de Jong ..... G09F 3/0295 40/645

FOREIGN PATENT DOCUMENTS

JP 2010-39156 A 2/2010
JP 3172611 U 1/2012
NL 1001353 C1 4/1997

* cited by examiner

LABEL FOR VEGETABLES, FRUIT AND HOUSE PLANTS

CROSS-REFERENCE TO RELATED APPLICATIONS

This application is the National Stage of International Application No. PCT/EP2013/000965 filed Mar. 28, 2013, which claims the benefit of Netherlands Application No. NL 1039498, filed Mar. 28, 2012, the contents of which is incorporated by reference herein.

FIELD OF THE INVENTION

This invention relates to a label with which, among other things, vegetables, for instance vine tomatoes, fruit and house plants, can be supplied with information. For the sake of simplicity, in this document, reference will mainly be made to the application of the label used for vine tomatoes. This does not however rule out any of the other applications in any way.

BACKGROUND OF THE INVENTION

The current technique of labelling vine tomatoes entails packaging the tomatoes in foil, possibly on a cardboard or synthetic tray and labelling the foil, by a self-adhesive label for instance. This is not the most durable way of coupling vine tomatoes with information. Labels are also used that are attached to one of the branches of a vine tomatoes by binding wire or cord.

SUMMARY OF THE INVENTION

The invention concerned is a three-dimensional object obtained by folding and gluing a punched or cut piece of paper, cardboard or another type of thin-walled material, which object can be attached to one or more branches of a vine of tomatoes and whereby at least one surface area of the three-dimensional object is visible in such a way that it can serve as an information-bearing surface. The three-dimensional object thereby serves as a label for the vine tomatoes. In the further description and in the conclusions, the object according to the invention will be referred to as the label. The invention will now be clarified with reference to figures.

DETAILED DESCRIPTION OF THE INVENTION

Figure 1:
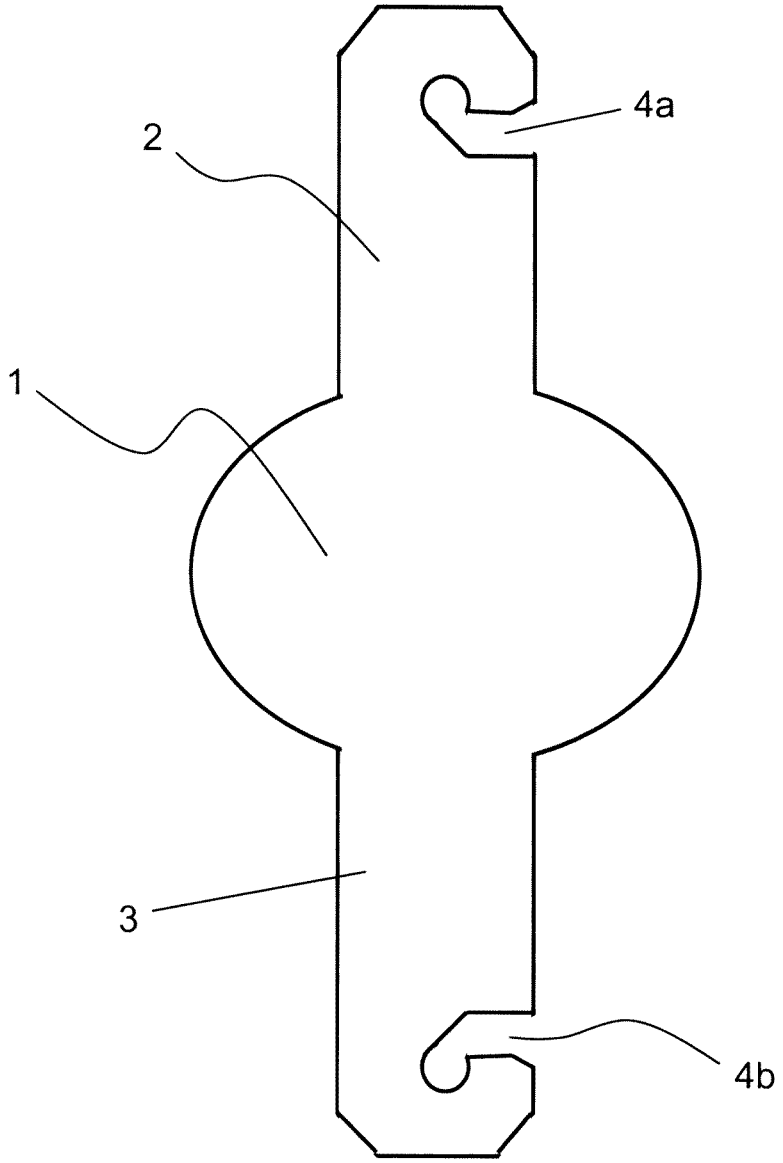
FIG. 1 shows a schematic frontal view of a design of the punched two-dimensional (initial) condition of the label according to the invention.

FIG. 1 shows a schematic frontal view of a design of the punched initial condition of the label according to the invention. In this initial condition, the label is primarily a two-dimensional object.

Where subsequently in this description and in the conclusions the term 'punched' is used, all other techniques used to give a product made from a thin-walled material a required shape will be understood. If paper or cardboard is used, punching is generally the most favourable working method for the production of large numbers of products with identical shapes. For this reason, for the sake of simplicity, punching is regarded as the preferable technique. In this context, cardboard may also mean relatively heavy paper, e.g. paper that weighs more than 200 grams per square meter.

In the design of a label according to the invention in its flat two-dimensional condition shown in FIG. 1, the label has a central surface area 1, hereinafter also referred to as the information-bearing surface 1, an initial fastening strip 2 and a second fastening strip 3, whereby with regard to a line at right angles to the longitudinal direction of the strips, these two fastening strips form each other's mirror image. In this design, the information-bearing surface 1 is oval-shaped. The invention allows, however, the information-bearing surface to take on any shape deemed desirable or useful. The information-bearing surface may for example be a shape which partially corresponds to that of the logo of the tomato grower or perhaps the shape of a heart, partially evoking the association of food which is good for the heart.

The fastening strip 2 has a punched-out shape 4*a* and the fastening strip 3 has a punched-out shape 4*b* which is the mirror image of 4*a*.

Figure 2:
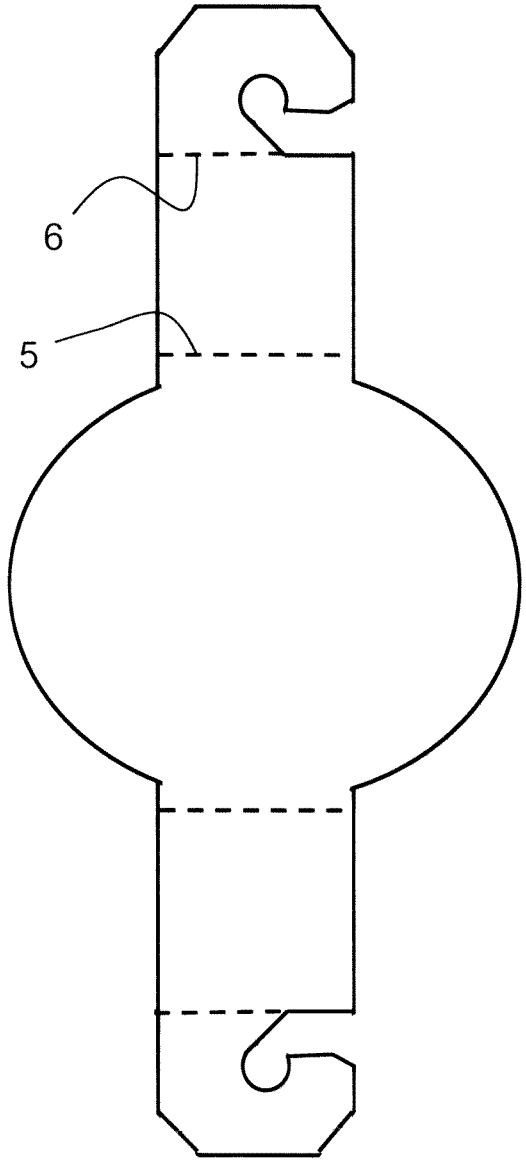
FIG. 2 shows a schematic frontal view of the design of the label according to the invention shown in FIG. 1, giving the label's folding lines schematically.

FIG. 2 shows a schematic frontal view of the design shown in FIG. 1 of the two-dimensional condition of the label according to the invention, whereby the label schematically shows the folding lines 5 and 6 by dotted lines on the fastening strip 2.

The fastening strip 3 also has two folding lines, here without a reference number.

Figure 3:
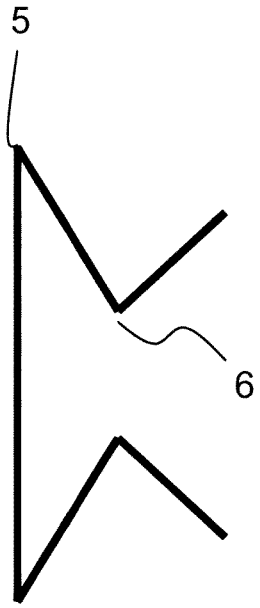
FIG. 3 shows a schematic side-view of the label shown in FIG. 2 partially folded along the folding lines.

FIG. 3 shows a schematic side-view of the label shown in FIG. 2 partially folded along the folding lines.

Figure 4:
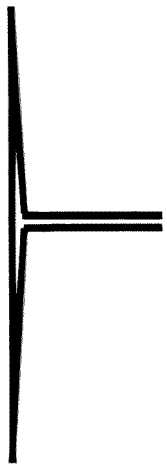
FIG. 4 shows a schematic side-view of the label folded along the folding lines shown in FIG. 3 to form a fully folded label ready for use.

FIG. 4 shows a side-view of the label folded from the partially folded state shown in FIG. 3 into a condition ready for use, whereby the back of the first folding part (closest to the information-bearing surface) of each fastening strip virtually lies against the back of the information-bearing surface and the back of both second folding parts of the two fastening strips, being the folding parts with the ends of the fastening strips, are virtually positioned against each other.

For the sake of the clarity, FIG. 4 deliberately shows a crack between the folded parts, so that each of the parts is still visible separately in the side-view.

Figure 5:
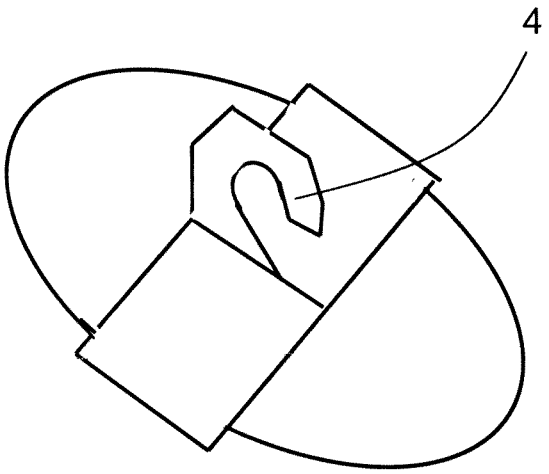
FIG. 5 shows a perspectival rear view of the schematic side-view in FIG. 4 of the fully folded label.

The intention of the invention is that one or more of the parts which are next to each other after folding are inseparably glued together or inseparably connected by means of a similar adhesive. Within the framework of the invention, it is even possible to attach the separate parts by means of a method based on Velcro principles. Where the description and the conclusions refer to the term glue or glued connection, this should also be understood to mean similar connecting materials or connections referred to herein. FIG. 5 shows a perspectival back view of the schematic side-view shown in FIG. 4 of the label folded into its ready to use state. FIG. 5 makes it very visible that after folding, the punched shapes 4*a* and 4*b*, formed from the second folding parts of the two fastening strips 2 and 3 jointly result in the contact element 4, hereinafter further referred to as the hook 4 of the label. The label according to the invention ready for use shown in FIG. 5 is a three-dimensional object.

Figure 6:
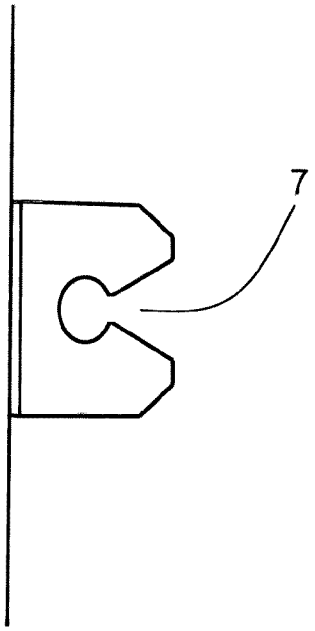
FIG. 6 shows a side-view of a design of the label according to invention with a second type of contact element.

In addition to the various label designs discussed above according to the invention which have a contact element in the shape of a hook 4 with which the label can be hooked to a branch or a vine of tomatoes, the invention also has other designs of the label's contact element. FIG. 6 shows a side-view of a design of the label according to the invention whereby the contact element has a click system 7 with a V-shaped entry and a circular insertion space. In this design, the label is 'clicked' onto a branch by pushing the label over a branch via the V-shaped entry, whereby after the passage between the V-shaped entry and the circular insertion space changes shape, the branch is taken up into the insertion space. A label attached to vine tomatoes in this way will not easily come off the vine by accident.

When attaching the design of the label to the vine tomatoes by means of a hook 4, by choosing a position whereby the vine and therefore the label are somewhat under tension, the label is also prevented from easily coming off the vine.

Figure 7:
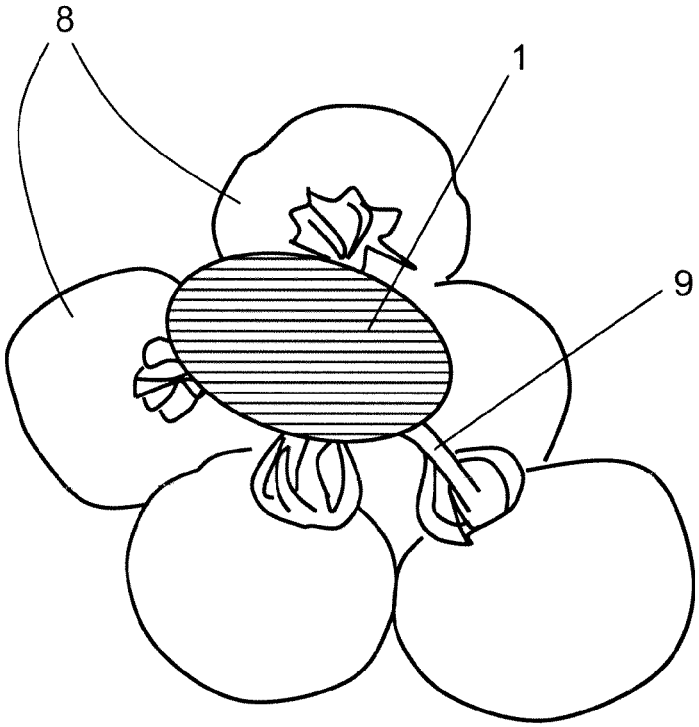
FIG. 7 shows a schematic view of a vine of tomatoes with a label attached according to the invention.

FIG. 7 gives a schematic view of a vine of tomatoes 8 with such a label according to the invention attached to branch 9 of the vine by means of the contact element that the information-bearing surface 1 of the label is easily visible.

In the designs of the label according to the invention discussed above, the label contains two fastening strips which mirror each other and which together, after having been folded and glued together, form the contact element. There are also designs of the label according to the invention whereby in its initial condition, the label only has one fastening strip, which after folding has the contact element. Due to the required strength of the contact element, this design requires the label to be made of a heavier type of paper (cardboard).

In its two-dimensional condition, the label is thin and flat and therefore takes up very little space when being sent. At the location where it is to be attached to the vine tomatoes, the label can subsequently be folded and glued together by machine and will thus take on its intended three-dimensional form.

The invention allows the label to be printed on in any way desired and to be made to display any information required, including, for example, one or more bar codes or similar codes such as QR. The label according to the invention can be any colour or of any texture desired. Besides being made of paper or cardboard, the invention also allows the label to be made of synthetic foil or a metal foil.

The invention also has designs whereby in its initial condition, the label has more than one component. The label can for instance be made up of two primarily two-dimensional objects which in their initial condition are separate, e.g. an information-bearing surface and a fastening with one or more fastening strips that have to be folded respectively. The information-bearing surface can be connected to the three dimensional fastening obtained from a primarily two-dimensional fastening by means of folding and the possible use of an adhesive.

The designs of the label according to the invention discussed in this description and shown in the figures are just a few of the many designs possible within the framework of the invention and must therefore be regarded as non-limitative.

The invention claimed is:

1. A label that can be hooked or clicked onto a vegetable or fruit stem or a stalk, branch or supporting rod for house plants, whereby in its initial condition, it is primarily a two-dimensional object with at least one fastening strip whereby by means of folding, this two-dimensional object can be transformed into a three-dimensional object with an information-bearing surface and a contact element in the form of a hook or a click system, which is configured to be respectively hooked around a branch or clicked on the branch through a V-shaped entry and extends away from the back of the information bearing surface at right angles thereto, wherein the fastening strip is folded along the first folding line and is on the back of the information-bearing surface whereby the part of the fastening strip between the two folding lines primarily runs parallel to the information-bearing surface and the surface area formed after folding along the second folding line by the hook or the click system is at right angles to the information-bearing surface and forms the contact element;

wherein the hook or click system is formed by the punched-out shape of the initial fastening strip and the punched-out shape of the second fastening strip, which are mirror images of each other; and wherein the label contains a glued connection and wherein the glued connection is in between the punched-out shape of the initial fastening strip and the punched-out shape of the second fastening strip.

2. The label according to claim 1, wherein in its two-dimensional condition, it has two fastening strips that are each other's mirror image.

3. The label according to claim 2, wherein together, the hook or the click system of each of the two fastening strips of the label in its ready for use condition primarily form a single hook or click system.

4. The label according to claim 1, with the feature that the label contains paper or a synthetic material.

5. The label according to claim 1, with the feature that the label contains a glued connection.

6. A kit comprising:

a vegetable or fruit stem or a stalk, branch or supporting rod for house plants; and a label that can be hooked or clicked onto a vegetable or fruit stem or a stalk, branch or supporting rod for house plants, whereby in its initial condition, it is primarily a two-dimensional object with at least one fastening strip whereby by means of folding, this two-dimensional object can be transformed into a three-dimensional object with an information-bearing surface and a contact element in the form of a hook or a click system, which is configured to be respectively hooked around a branch or clicked on the branch through a V-shaped entry and extends away from the back of the information bearing surface at right angles to it, wherein the fastening strip is folded along the first folding line and is on the back of the information-bearing surface whereby the part of the fastening strip between the two folding lines primarily runs parallel to the information-bearing surface and the surface area formed after folding along the second folding line by the hook or the click system is at right angles to the information-bearing surface and forms the contact element.

7. The kit according to claim 6, wherein the label, in its two-dimensional condition, has two fastening strips that are each other's mirror image.

8. The kit according to claim 7, wherein together, the hook or the click system of each of the two fastening strips of the label in its ready for use condition primarily form a single hook or click system.

9. The kit according to claim 6, with the feature that the label contains paper or a synthetic material.

10. The kit according to claim 6, with the feature that the label contains a glued connection.

11. The kit according to claim 6, wherein the hook or click system is formed by the punched-out shape of the initial fastening strip and the punched-out shape of the second fastening strip, which are mirror images of each other.

12. The kit according to claim 11, wherein the label contains a glued connection and wherein the glued connection is in between the punched-out shape of the initial fastening strip and the punched-out shape of the second fastening strip.

13. A method for applying a label to a vegetable or fruit stem or a stalk, wherein the method comprises the steps of:

providing a kit, comprising:

a vegetable or fruit stem or a stalk, branch or supporting rod for house plants; and a label that can be hooked or clicked onto a vegetable or fruit stem or a stalk, branch or supporting rod for house plants, which is primarily a two-dimensional object with at least one fastening strip;

transforming, by means of folding, the two-dimensional object into a three-dimensional object with an information-bearing surface and a contact element in the form of a hook or a click system, which extends away from the back of the information bearing surface at right angles to it, wherein the fastening strip is folded along the first folding line and is on the back of the information-bearing surface whereby the part of the fastening strip between the two folding lines primarily runs parallel to the information-bearing surface and the surface area formed after folding along the second folding line by the hook or the click system is at right angles to the information-bearing surface and forms the contact element; and hooking the label around the stem or the stalk or clicking the label on the stem or the stalk through a V-shaped entry of the contact element.

14. Method according to claim 13, comprising the step of applying a glued connection to the label to secure the transformed label in the three-dimensional state.

* * * * *